US005329593A

United States Patent [19]

Lazzeroni et al.

[11] Patent Number: 5,329,593

[45] Date of Patent: Jul. 12, 1994

[54] NOISE CANCELLING MICROPHONE

[76] Inventors: John J. Lazzeroni, 15631 N. Oracle Rd., No. 111, Tucson, Ariz. 85737; Melinda K. Carevich, 1415 S. Cherry, Tucson, Ariz. 85713

[21] Appl. No.: 59,138

[22] Filed: May 10, 1993

[51] Int. Cl.[5] ..... H04R 25/00; G10K 13/00

[52] U.S. Cl. ..... 381/168; 381/122; 181/158

[58] Field of Search ..... 381/168, 169, 69, 122, 381/151, 188, 205, 183, 187; 181/242, 158

[56] References Cited

U.S. PATENT DOCUMENTS 3,876,843 4/1975 Moen ..... 381/69

*Primary Examiner*—Curtis Kuntz
*Assistant Examiner*—Sinh Tran
*Attorney, Agent, or Firm*—J. Michael McClanahan

[57] ABSTRACT

A noise cancelling microphone for use in noisy environments is disclosed wherein noise entering the front portion of the microphone housing to impinge upon the microphone cartridge diaphragm is also permitted to enter proximate the rear portion of the microphone housing through strategically located inlet openings. This allows noise to impinge upon the back surface of the microphone cartridge diaphragm to effect a cancellation of diaphragm vibrations. These strategically located inlet openings at the top and the bottom of the rear of the microphone housing are situated so as to be directionally orientated towards the greatest source of the noise, namely orthagonal to the directional line of the front inlet openings and out of the path of the incoming air. The size and number of the top and bottom rear inlet openings are regulated and situated so that as the microphone is used in such a setting as a motorcycle rider, they are vertically oriented since the greatest source of noise (outside of horizontal wind) is above or below the operator.

14 Claims, 2 Drawing Sheets

NOISE CANCELLING MICROPHONE

BACKGROUND OF THE INVENTION

1. FIELD OF THE INVENTION

The field of the invention is microphones useful in a combination of high wind and high noise environments such as microphones operably attached to helmets worn by motorcycle riders.

2. DESCRIPTION OF THE RELATED ART

In recent years, persons operating in high wind and noise environments, such as motorcycle riders, have enjoyed vast improvements in the ability to carry on conversations. This is especially true in respect to communications between a motorcycle driver and passenger, as well as between a motorcycle driver and/or passenger and other motorcycle drivers and their passengers, all while the motorcycles are moving. Such improvements include the installation of microphones proximate the driver's and passenger's mouth by attachment to the motorcycle helmet, whether by attachment to a boom connected to the lower lip of the side of a motorcycle helmet (one-half or three-quarter style helmet), or within the helmet confines of full coverage style helmets. In addition, the present art also includes the installation of earphones in the helmets of both driver and passenger, e.g., see the Inventors' 1990 patents entitled VENTED MOTORCYCLE HELMET SPEAKER ENCLOSURE (U.S. Pat. No. 4,977,975) and ACOUSTICALLY SHIELDED MOTORCYCLE HELMET SPEAKER ENCLOSURE (U.S. Pat. No. 4,979,586).

As might well be expected, during travel a motorcycle driver and passenger are exposed to vast amounts of noise that is ever present in their immediate environment. In addition to the noise of the motorcycle engine, the road sounds, i.e., sounds of the tires engaging the road, and sounds of nearby vehicles, the motorcycle rider and passenger are also immersed in sounds of air rushing past the motorcycle, past the motorcycle faring, and past the body and face. The noise sounds immediately in front of the mouth of the motorcycle rider wearing a one-half or three-quarter style helmet, or inside a full coverage style motorcycle helmet, present a very special noise environment.

For highest quality sound transmission, the microphone should not, as far as possible, transmit entering sounds except for the driver's and passenger's speech, and as to the speech, it should be as clear as possible. As such, efforts need to be directed to assuring that, as much as possible, only speech sounds enter the microphone immediately in front of the driver's and passenger's respective mouths. If only the party's speech is received by the microphone and converted to electrical signals for transmission to the other rider, or to distant motorcycle drivers and passengers, then much has been contributed to present efficient communication with maximum clarity and minimum distortion.

In today's motorcycle riding, it is common to place a microphone immediately in front of the driver's or passenger's mouth, held there by the helmet being worn. In the case of a one-half or three-quarter style helmet, the microphone housing is supported by a boom attached to the lower lip of the helmet, on one side of the helmet or the other, protruding forward and usually curved around to be situated an inch or so from the operator's mouth. These booms generally consist of flexible spiral steel tubing having a hollow central passageway adapted to conduct the electrical leads from the microphone cartridge to an electronic package mounted on the motorcycle. In most all cases, the microphone is covered with a wind sock made of open cell foam rubber or plastic.

In a full coverage style helmet, a helmet which totally covers the operator's head, the microphone is mounted near the bottom opening (through which one's head passes when putting on the helmet) at a position immediately forward of the operator's mouth.

For both types of helmets, sound entering inlet openings in the microphone housing are situated so as to be in directional alignment with the operator's mouth. Openings on the opposite side of the microphone housing are usually non-existent, primarily because that portion of the microphone housing is usually in a position to receive wind directly when an operator is wearing a helmet with the microphone attached and traveling, especially the one-half and three-quarter style helmet. The noise factor caused by the wind becomes quite severe.

In most instances, the microphone cartridge contained within the housing has a round diaphragm upon which incoming sound waves impinge. The microphone diaphragm reacts by vibrating in resonance with the striking sound waves and as it does, generates perturbations in an electrical signal supplied to the cartridge. These perturbations are conveyed to connected electronic equipment, amplified and distributed to the headsets of other parties, whether by transmission via electrical leads or by radio. The efficiency of the microphone cartridge is at its highest if the sound waves strike the diaphragm as near normal as possible, i.e., transverse to the plane of the annular diaphragm. As a consequence, microphone housings containing the microphone cartridge usually have inlet openings immediately in front of the diaphragm so as to cause sound to strike the diaphragm substantially at right angles.

Since the incoming waves dissipate their energy in making the microphone diaphragm vibrate, it is common to vent the chamber or plenum immediately behind the diaphragm. This is done for various reasons, not the least of which is that failing to vent the plenum behind the diaphragm means that the diaphragm is required to momentarily compress the air behind the diaphragm as the diaphragm moves back and forth during its vibrations. Thus the energy needed to compress the air subtracts from the energy used in moving the diaphragm, making the microphone cartridge less sensitive. In addition, it is common to isolate the plenum immediately behind the diaphragm from the plenum immediately in front of the diaphragm so that sounds impacting upon the front surface of the diaphragm cannot then bounce around to the rear of the housing then engage the backside of the diaphragm. Such will cause distortion in the microphone output signal because the sound waves on the back surface of the diaphragm subtract from the sound waves on the front surface, all tending to reduce the vibration displacement of the diaphragm to incoming sound waves, even those intended to be sensed.

Microphone cartridges generally are button like cylinders having a front flat or slightly cone shaped circular diaphragm which substantially occupies a flat plane even though that plane may have a little thickness. The diaphragm usually has a rear annular ring shaped exposed side. Best results are achieved when the incoming sound waves strike the front side of the diaphragm along the cylindrical axis of the microphone cartridge. This is accomplished easily by situating the front inlet openings in the microphone housing parallel to the cylindrical axis of the cartridge. Similarly, vent holes in the rear side of the microphone housing are opposite the back side of the diaphragm surface, also parallel to the cylindrical axis of the cartridge.

In most situations of motorcycle use, and especially with the one-half and three-quarter style helmet, the microphone housing encapsulating the microphone cartridge has inlet openings in front of the cartridge, but no vent openings at the rear of the housing since such vent openings would be the immediate recipient of wind as the motorcycle rider travels along. This wind, if incoming through vent openings immediately behind the microphone cartridge, would seriously detract from the speech reproduction qualities of the microphone.

In the motorcycle environment, as stated above, the motorcycle driver and passenger are placed in an exceptionally windy and noisy environment, especially due to noise causing elements located immediately below the microphone worn by the operator. These noises, the motorcycle engine noise, road noise, and wind noise, tend to enter the front inlet openings in the microphone housing directly in front of the operator's mouth. Now efforts have been taken to reduce noise input by utilizing front inlet openings which are rather narrow, i.e., the diameter of the opening is quite small compared with the length of the opening through the housing. This tends to make a microphone somewhat directional, i.e., more readily receiving sounds in alignment with the inlet openings rather than sounds coming from other directions, such as below. However, as motorcycle riders can attest, environmental noise does in fact impinge upon the microphone cartridge diaphragm and does substantially contribute to degrading the quality of speech out of the microphone.

As a consequence, if means could be found to effect noise cancelling techniques upon the microphone, the speech reproduction qualities of the microphone would be greatly enhanced. It is to this end that the subject invention is directed.

SUMMARY OF THE INVENTION

The embodiment of the invention described consists of a microphone for use in high wind and noisy environments and particularly in connection with motorcycle helmets and other types of helmets wherein noise cancelling techniques are employed to effectively reduce noise picked up by the microphone cartridge interiorly to a microphone housing and transmitted out on electrical leads. These improvements include utilizing the noise of the surrounding environment to cancel itself as it is detected by the microphone cartridge. Since, as it has already been alluded to, the noise surrounding the microphone in a motorcycle environment is so great, even with the employment of sound directional inlet channels, i.e, front inlet openings, oriented to be substantially in line between the speaker's mouth and the diaphragm of the microphone cartridge, yet because of the strength of and pervasiveness of the noise sound waves, environmental noise still does enter the front inlet openings to impinge upon the front surface of the diaphragm of the microphone cartridge and thus appear on the electrical signal output of the microphone.

However, it is possible to effect a cancellation of the impingement of the noise upon the front surface of the microphone diaphragm by placing the same noise sound wave, in phase, upon the back or rear side of the diaphragm. The procedure is to hit the diaphragm on both sides simultaneously with the same sound waves, and with the same relative strength, thus nullifying the effect of the noise sound waves. In this case, only the noise sounds are utilized. The speaking voice is not permitted to enter into the rear area of the microphone housing to impinge upon the back side of the diaphragm.

The above goals are accomplished by selectively locating directional type inlet openings into the rear portion of the microphone so that the inlet openings are aligned with the greatest source of noise of the environment. Also, by such alignment, the speaking voice is also prevented from entering the rear area of the microphone housing. In addition, the volume of the noise entering the rear area of the microphone housing is regulated by control of the size and number of the inlet openings.

More specifically, to accomplish the above invention, the microphone housing is specially designed and constructed to secure the microphone cartridge within. At the front of the microphone housing are a plurality of inlet openings, the diameters of the openings being substantially smaller than the lengths of the openings so as to provide a degree of directivity to sound waves which enter these front inlet openings. The lengths of the inlet openings are determined by the thickness of the material (usually hard plastic) in the front portion of the housing. Once the thickness of the housing is known, the diameter of the inlet openings is then determined such as to maintain a length which is three to five times longer than the diameter.

Since the microphone is situated directly in front of the speaker's mouth, whether held there by a boom attached to the helmet of the speaker, or placed within the helmet itself (in case of full coverage style helmets), sound waves spoken by the wearer will proceed directly through the front inlet openings of the microphone housing. Spaced between the front inlet openings and microphone cartridge diaphragm is a small plenum. This plenum may contain a disk made of soft, pliable, open cell plastic foam.

In the preferred embodiment, the microphone cartridge is held within a small annularly shaped cylindrical socket having an open top, the socket in turn secured within the housing with non-vibration transmitting rubber grommets. Covering the open top of the socket is a socket cap having a plurality of vents therethrough to allow the sound waves emerging from the inlet openings into the plenum (or plastic foam) to then pass through the vents and impinge upon the annularly shaped and generally planar diaphragm of the microphone cartridge. The electrical leads attaching to the microphone cartridge exit the socket through an opening at or near the bottom. Further, the socket's annular base is also vented to allow sound waves to enter or leave. Thus, the back side of the diaphragm is contactable by sound waves entering the rear of the socket through the vents.

Lastly, immediately behind the outside surface of the base of the socket is a second plenum defined on the opposite side by the inside face of the rear housing cap secured to the bottom opening of the rear housing. This plenum, like the front plenum, may also contain one or more soft, pliable, open cell plastic foam disks. Further this plenum connects with a strategically placed sound inlet openings communicating with the surrounding environment. These inlet openings, which may be varied in number and size in the preferred embodiment, are not directionally aligned with the inlet openings characterizing the perforated annular front element which receive the operator's voice, but in fact are specifically orientated in the direction of the offending noise, and away from the unwanted wind, namely at right angles to the cylindrical axis of the microphone housing and contained microphone cartridge and to the longitudinal axis of the front inlet openings. The rear inlet openings, controlled in number and size, are more specifically located in the vertical direction (as the microphone would be situated during use) so as to be aimed in the direction of the primary source of noise once the wind noise has been avoided.

Since it is desirable to locate the front inlet openings receiving the speaker's voice so that sound passes through them to impinge at right angles to the plane of the microphone cartridge diaphragm to achieve best results, and since it is advantageous to fashion the front inlet openings with a length several times their diameter so as to impart directionality to entering sounds, means must be provided to cancel noise which, although not intended, enters the front inlet openings of the microphone housing to impact upon the diaphragm. Because of the usual orientation of the microphone and the fact that the greatest source of noise (after wind noise is eliminated) is localized substantially below the microphone, the rear inlet openings are placed so as to admit a portion of that noise, namely, the inlet openings are situated orthagonal to the direction of the primary incoming speech sounds.

By such an invention, noise sound waves entering the front of the microphone housing are cancelled at the diaphragm by the same noise, in phase, entering the rear inlets openings converging upon the rear surface of the microphone cartridge diaphragm.

When using the microphone for various different noise environments, or for that matter, even different motorcycles if that is the environment, the number of inlet openings and their respective diameters at both the top and the bottom in the rear cap may be varied. It may be necessary to selectively plug, or open, these holes for each particular circumstance. Trial and error placement of the microphone into each environment to see exactly what arrangement of inlet openings are best for each case may be necessary.

Accordingly, it is an object of the subject invention to provide a noise cancelling microphone enclosure wherein environmental noise entering the front of the microphone housing may be eliminated.

It is another object of the subject invention to provide a microphone housing wherein noise sounds entering the front of the microphone are cancelled by the same noise sounds in phase entering the rear portion of the microphone housing.

It is still another object of the subject invention to provide rear located openings not in the path of the wind or rushing air.

It is still another object of the subject invention to provide a microphone housing which allows offending noise sounds to be cancelled at the microphone cartridge diaphragm by permitting the same in phase noise waves to impinge on the rear surface of the diaphragm.

It is still a further object of the subject invention to provide a noise cancelling microphone wherein rear noise inlet openings are provided in the microphone housing specifically orientated towards the source of noise.

It is still another further object of the subject invention to provide a noise cancelling microphone wherein the cylindrical orientation of the rear noise inlet openings in the microphone housing are orthagonal to the cylindrical orientation of the front primary sound inlet openings.

Other object of the invention will in part be obvious and will in part appear hereinafter. The invention accordingly comprises the apparatus possessing the construction, combination of elements, and arrangement of parts which are exemplified in the following detailed disclosure and the scope of the application which will be indicated in the claims.

BRIEF DESCRIPTION OF THE DRAWINGS

For further understanding of the features and objects of the subject invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
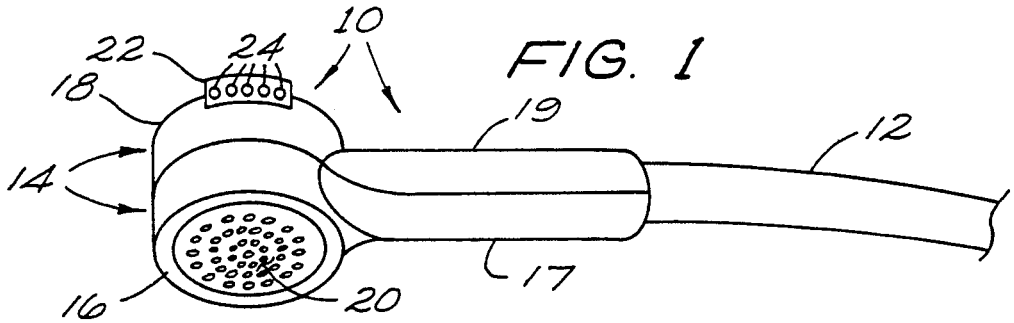
FIG. 1 is a perspective view of the subject inventive noise cancelling microphone.

Referring now to FIG. 1, a perspective view of the subject noise cancelling microphone 10 is shown. In the embodiment disclosed, microphone 10 shown is intended to be extended from the lower lip of a helmet, such as a motorcycle helmet, by flexible boom 12. Flexible boom 12 accomplishes two purposes, firstly, that of locating the microphone proximate the helmet wearer's mouth, and secondly, that of conveying electrical wires through its interior to connect to the microphone cartridge contained within a cavity formed in microphone housing 14 located at the end of boom 12. Microphone housing 14 comprises two primary components, namely front housing 16 and rear housing 18. These two elements encapsulate the microphone cartridge and are preferably made of plastic. They are welded together along their upper peripheral edges after the interior elements are in place and one end of flexible boom 12 situated in the handle portions 17 and 19 shown.

Both front and rear housing 16 and 18 respectively take on the appearance of a frying pan with a hole in its bottom when viewed individually. Each piece consists of a cylindrical portion connected by a semi-circularly elongated trough like handle, the cylindrical portion in both characterized as being open at the top and the bottom. The interior cylindrical wall of each piece is stepped to form a slightly smaller opening inside. Since the pieces are joined at their top openings, the top opening of both pieces have the same diameter, although the bottoms openings need not. The periphered edge along the top opening of each cylindrical portion together with the top edge of the semi-circular shaped elongated trough are ultrasonically welded together as the invention is assembled. The bottom opening of each housing receives another element, that element being different depending on whether it is the front housing or the rear housing.

More particularly, in FIG. 1 attached centrally to front housing 16 at its bottom opening is annular perforated front element 20 which allows entrance of sound waves spoken by the operator into an interior cavity containing a microphone cartridge described later. Perforated element 20 contains a relatively large number of small openings whose lengths are substantially longer than their diameters. This makes the passageways for sound waves into the microphone directional, i.e., they accept sounds coming from one direction more readily than sounds coming from other directions, all to reduce entrance of surrounding extraneous noise.

Attached to and encompassing the bottom opening of rear housing 18 is the rear housing cap 22 (of which only a top portion is shown) which embodies the invention. Rear housing cap 22 has one or more stratigically placed noise cancelling inlet openings 24 shown communicating the interior plenum behind the microphone cartridge (interior to noise cancelling microphone 10) to the outside environment. In the preferred embodiment, inlet openings are present only at the top and the bottom of rear housing cap 22. For various different environments, various numbers of the noise entering openings at each the top and bottom of rear housing cap 22 may be present, from 0 to as many may be placed within the space allotted. These openings, having a length much greater than their diameter, are also directional in terms of noise that is permitted to enter the plenum behind the microphone cartridge in rear housing 18.

Lastly, shown as part of the front and rear housing 16 and 18 are the frying pan handle like extensions 17 and 19 respectively.

Figure 2:
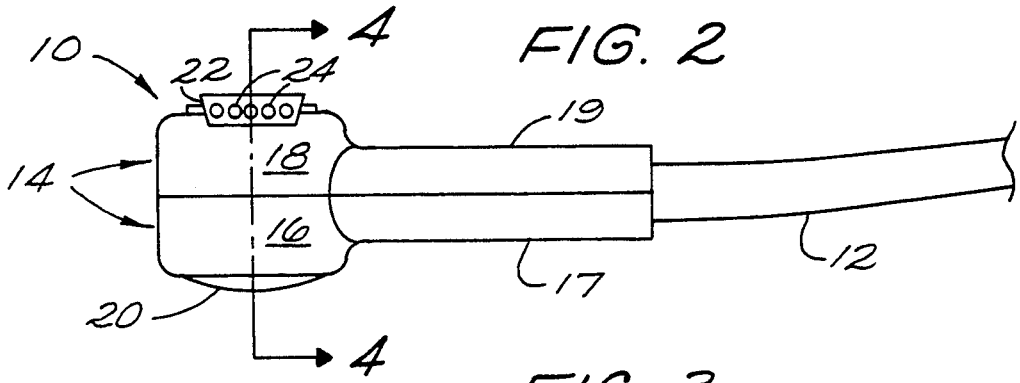
FIG. 2 is a top view of the subject inventive noise cancelling microphone.

Referring now to FIG. 2, subject noise cancelling microphone 10 is illustrated in a top view showing primarily front and rear housing 16 and 18 respectively, each with their handle like extensions 17 and 19. Emerging from the joinder of extensions 17 and 19 is flexible boom 12. Attached at opposite sides in each of the bottom openings of front and rear exterior housing 16 and 18 are annular perforated front element 20 and rear housing cap 22 respectively. Lastly, rear inlet openings 24, which permit entrance of selected noise into the rear of rear exterior housing 18, are shown in the top of rear housing cap 22.

Figure 3:
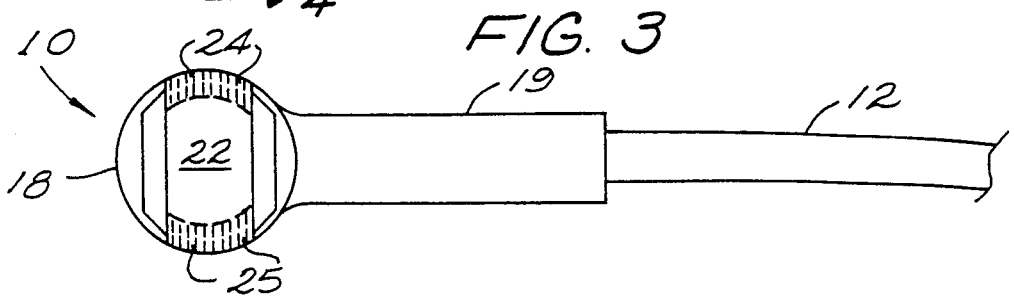
FIG. 3 is a bottom view of the subject inventive noise cancelling microphone.

FIG. 3 is a bottom view of subject noise cancelling microphone 10 wherein is seen rear housing cap 22 encompassing the bottom opening of rear housing 18. It is seen from this view that there are no noise entering inlet openings immediately rear of the microphone housing, i.e., in alignment with the front inlet openings of the annular perforated front element, and that the noise entering inlet openings 24 and 25 shown in dotted form will permit entrance of sound at right angles to the cylindrical axis of the formed cylinder which houses the microphone cartridge. Noise inlet openings 24 and 25 are also transverse to the cylindrical axis of the microphone cartridge (shown later).

These rear inlet openings are thus directional in that the location of the microphone, when attached to the helmet of the operator, and with the operator sitting upright, the inlet openings are vertical. They are also parallel to each other, and have small diameters compared to their lengths. This affords directivity, i.e., admitting noise sounds emanating from below the microphone housing. These noise sounds will be the same noise and thus in phase with the greatest source of noise entering microphone 10 through perforated front element 20. In the case of motorcycle riders, the most common noise will be the sounds immediately below the rider, i.e., noise of the tires on the pavement, noise of the wind rushing around the motorcycle farings, and engine noise. On the upper noise entering openings, the admission of noise may not be as critical and it may be possible that a reduced number of openings (as compared to the bottom) are needed because overhead noise is not likely to be as great as noise from below.

Figure 4:
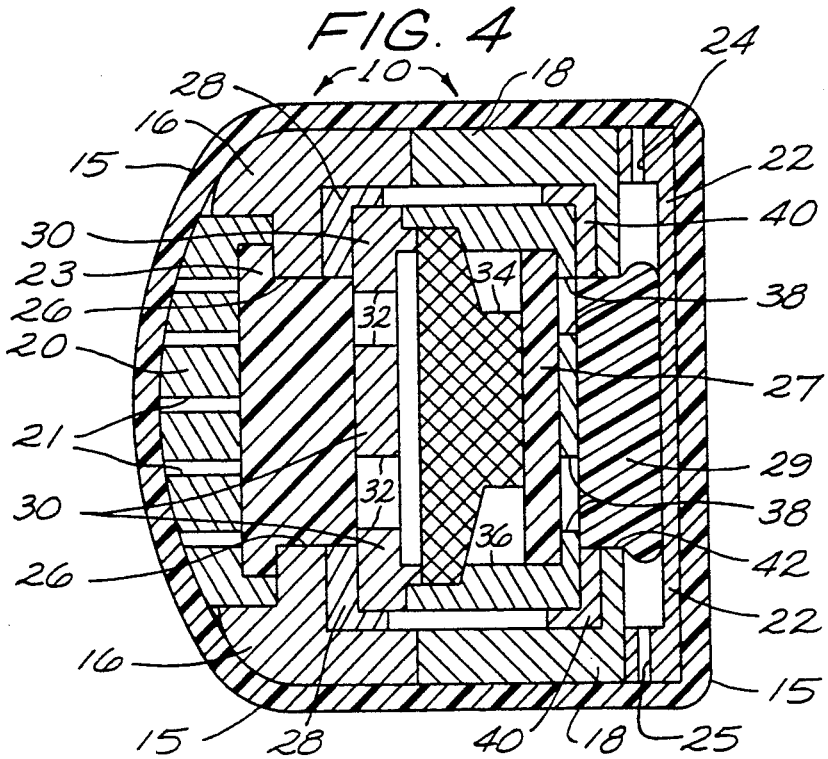
FIG. 4 is a cross-sectional view taken along sectional line 4—4 of FIG. 2 of the subject inventive noise cancelling microphone.

Lastly, from the embodiment of the noise cancelling microphone shown in FIGS. 1–3, a cross-sectional view of front and rear housing 16 and 18 taken along sectional lines 4—4 of FIG. 2 is shown in enlarged detail in FIG. 4. More specifically, and beginning at the left hand portion of FIG. 4 and moving right, at the very outside is microphone housing wind sock 15 which slips on to totally surround microphone 10 and which is made of a soft, pliable, open cell plastic foam. This protects the microphone while allowing in sounds but rejecting very soft noise. Following wind sock 15 is perforated annular front element 20 showing in cross-section five elongated openings 21 to allow entrance of sound, each of the openings being of a length greater than its diameter so as to have directional qualities, i.e., rejecting sounds (as much as possible) coming in directions not in front of the microphone. Perforated annular front element 20 resides in an annular recess formed in the bottom opening 26 of front housing 16, annular element 20 plastic welded in place during assembly of microphone 10.

A front plenum follows annular front element 20, this front plenum filled up with disk 23, an open cell, soft, pliable plastic foam which permits the passage of sounds.

Continuing to the right, annular rubber grommet 28 is shown residing in the base of an annular recess formed in the top opening of in front housing 16. Annular grommet 28 receives cap 30 of a microphone cartridge cup like socket in a annular recess formed within itself. Cap 30 has a plurality of openings or vents 32 therein to permit sounds to pass through it. Vented socket cap 30 is also annular in shape and helps secure microphone cartridge 34. Microphone cartridge 34 receives sounds through immediately adjacent openings 32 of vented microphone socket cap 30. Microphone cartridge 34 resides in cylindrical (cup shaped) socket 36, socket 36 having a bottom flat base also with a plurality of vents or openings 38 therethrough. To the rear of microphone cartridge 34 and within the confines of socket 36 is open cell plastic foam 27, which also allows passage of sound. Securing microphone cartridge socket 36 at its base to rear housing 18 is second annular rubber grommet 40, grommet 40 residing in a annular recess formed in the cylindrical walls of rear housing 18. Grommet 40 also has an annular notch cut in its interior surface to receive the cylindrical sides and base of microphone cartridge socket 36. Immediately behind or to the right of grommet 40 is bottom opening 42 through rear housing 18. Rubber grommets 28 and 40 act as shock absorbers in that they do not pass vibrations from outer housing 16 and 18 to socket 36 and its cap 30 and on to microphone cartridge 34.

Following microphone cartridge socket 36 is disk 29 filling the plenum situated immediately to the rear of socket. Disk 29 is an open cell plastic foam, soft and pliable, which allows passage of sounds.

Lastly, shown attached to the outer portion of rear housing 18 and covering bottom opening 42, is rear housing cap 22 with its top and bottom rear inlet openings 24 and 25 respectively. It is noted in FIG. 4 that the cylindrical axis of openings 24 and 25 are at right angles or transverse to the cylindrical axis of the cylindrical cavity portion of front and rear housings 16 and 18 which contain the microphone cartridge and, also transverse to the cylindrical axis of annularly shaped microphone cartridge 34.

Figure 5:
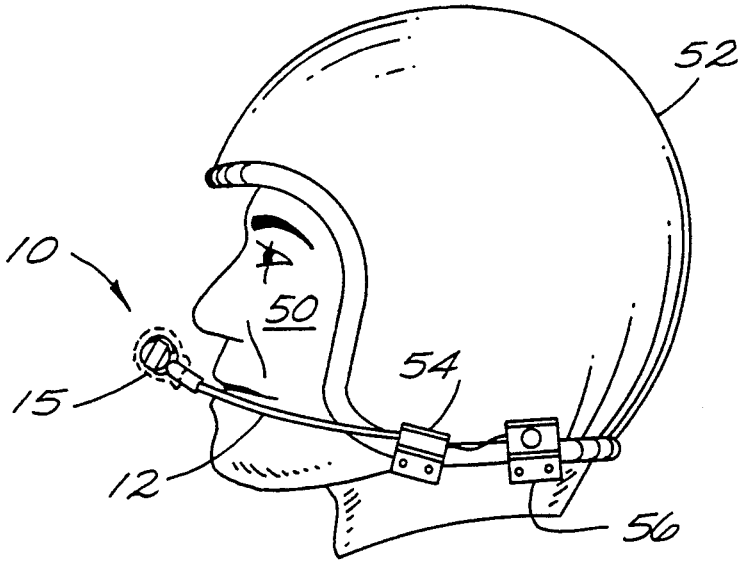
FIG. 5 is a side view of an operator wearing a one-half style motorcycle helmet showing the invention.

With noise cancelling microphone 10 situated at the end of boom 12, which in turn is attached to the one-half style helmet shown in FIG. 5, microphone 10 is positioned in front of the operator's mouth with the cylindrical axis of the noise cancelling openings 24 and 25 oriented vertically (or to the direction of the offending noise). More particularly, operator 50 is shown with the invention in place in front of his mouth, supported by boom 12. Microphone wind sock 15 surrounding microphone 10 is shown in dotted form. Boom 12 is secured to the side of helmet 52 by boom mount 54. Electrical leads from microphone 10 through boom 12 and mount 54 are collected at plug mount 56.

The operator's voice, together with some extraneous environmental noise, enters microphone 10 through directional front openings 21 in perforated annular front element 20 (FIGS. 1 and 4). By the directional orientation of openings 21, noise in the surrounding environment, principally noise from the tires contact with the pavement, noise of wind rushing around the motorcycle farings and engine noise, are to a large part excluded from entering front element 20 although a portion of this extraneous noise does enter microphone 10 through openings 21. It is this noise that is desired to be cancelled.

The operator's speech as well as noise entering through annular perforated front element 20 pass through the front plenum and the plastic foam held there and through top opening 26 and vents 32 to impinge upon microphone cartridge 34 (FIG. 4). Microphone cartridge 34 converts these sounds into electrical signals which are directed to electronic circuitry (not shown) through electrical wires which emerge from cartridge 34 to run through boom 12.

Since it is desired that only the sounds of the operator's voice be amplified, sound waves due to extraneous environmental noise are sought to be cancelled. Thus the invention now comes into play. It is known to vent the rear plenum behind a microphone cartridge with openings which are in line and parallel to a cylindrical axis passing through the front surface of the diaphragm of the microphone. This is done principally to reduce the resistance to vibration of the cartridge diaphragm in that the diaphragm compresses the air behind it as it moves. Effectively increasing the volume of the plenum behind the diaphragm reduces the energy needed to move the diaphragm so that the speech sounds striking the diaphragm displace the diaphragm more efficiently. Generally also, the incoming sounds to the microphone diaphragm are also at right angles to the plane of the diaphragm. In the case illustrated in FIG. 4, the front of diaphragm of microphone cartridge 34 is the left hand side edge of cartridge 34, in position to receive sound in through openings 21 of perforated cap 20.

However, since the back of microphone 10 is located to receive wind as a motorcycle is ridden, openings parallel to the cylindrical axis of the microphone would permit the entrance of in-rushing air and would create noise that would not necessarily be present at the front side of the microphone immediately facing the operator. Additionally, in an environment such as the motorcycle, the source of noise other than the wind is to a large extent localized, for the most part vertically below the microphone. Thus, permitting entrance of extraneous sounds and noise only from the bottom which is from the same source, and thus in phase as that noise entering the front portion of the microphone, accomplishes the purposes of noise cancellation.

Noise cancellation techniques employed by the inventors permit a small part of the noise sound waves to enter the microphone housing through directed inlet openings into the rear plenum, through the open cell plastic foam, to impinge upon the rear surface of the diaphragm of the microphone cartridge at the same time the same noise is engaging the front surface of the diaphragm of the microphone cartridge. Thus, a cancellation of each other at the diaphragm takes place. By the design shown in the embodiment of the invention, only those sounds which contribute largely to the noise which enters with the operator's speech are permitted to enter the rear portion of the microphone housing to effect the cancellation. Such is accomplished by placing the noise inlet openings 24 and 25 (FIGS. 1–4) in a position such that they are vertical when the microphone is utilized in such a setting as motorcycle riding. It is expected that noise incoming through upper rear noise inlet opening 24 will not be of the magnitude as noise entering lower rear noise inlet opening 25 and therefore, normally there will be more lower inlet openings than upper inlet openings.

Figure 6:
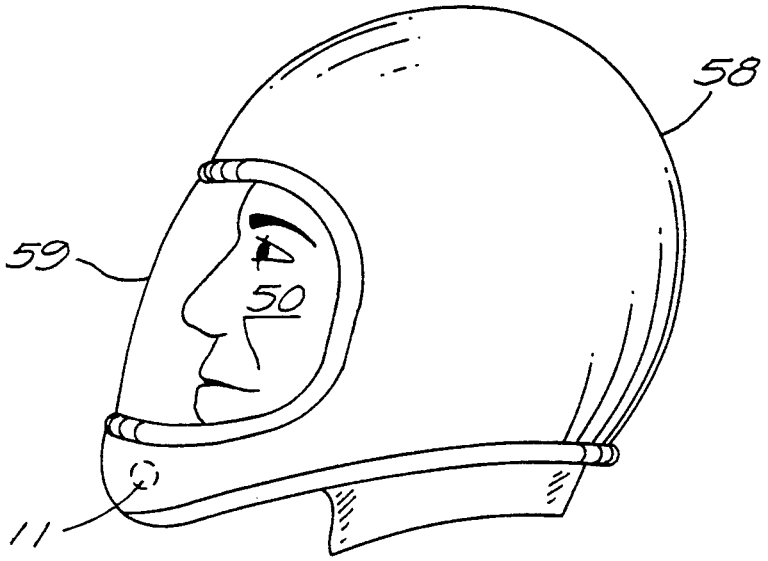
FIG. 6 is a side view of an operator wearing a full coverage style helmet showing an alternate embodiment of the invention.

An alternate embodiment of the invention comprises utilization of a modification of the invention in the full coverage style helmet such as the example shown in FIG. 6. More particularly, full coverage style helmet 58 shown completely enclosing the head of operator 50 allows the operator viewing through front transparent visor 59. Shown in dotted form in the lower right hand portion of FIG. 6 is the invention, namely noise cancelling microphone 11. The microphone is located totally within the confines of helmet 58 and is situated principally between the layers of material comprising the hard outer shell and the softer inner shell of the helmet. Application of the invention to the full coverage style helmet is beneficial as the noise enters the bottom opening of the helmet to enter into the front entrance portion of the microphone.

The microphone is situated with its front portion protruding through an opening in the inner shell (with the greater part of the microphone housing residing in the plenum between the inner and outer shell) to be proximate the operator's mouth. Noise principally from below the helmet enters into the helmet through the head opening to impinge upon the front entrance of the microphone. Noise will also enter into the plenum between the inner and outer shall of the helmet through passageways and other openings around the peripheral bottom opening of the helmet. Lastly, noise will also enter through small clearances between the visor and the surrounding helmet body.

As a result of this, the same noise that impinges upon the front of the microphone is also available to the rear of the microphone housing where it is used by the invention to effect noise cancelling techniques previously discussed.

Figure 7:
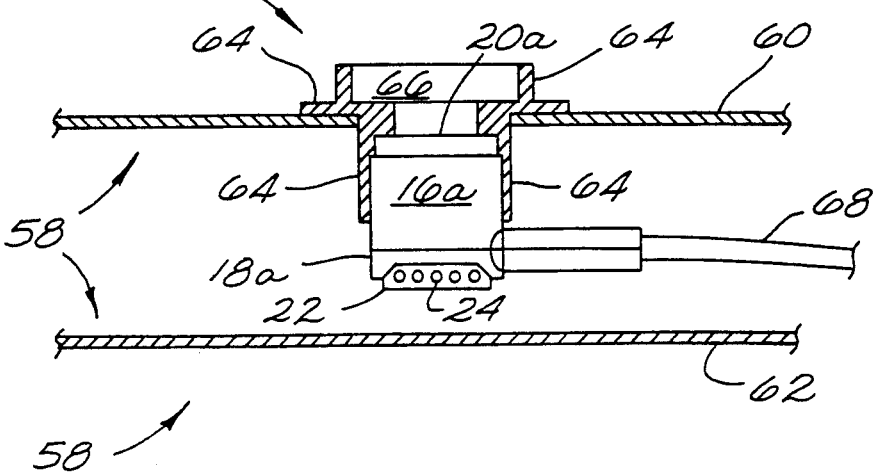
FIG. 7 is a partial cross-sectional view of the full coverage style helmet of FIG. 6 showing the alternate embodiment of the invention in place.

A partial cross-sectional view of noise cancelling microphone 11 is shown in FIG. 7 where inner shell 60 and outer shell 62 of helmet 58 is shown in cross-section. Also shown in cross-section is rubber or soft plastic sleeve 64. Sleeve 64 is an elongated cylindrical sleeve which receives and secures the outer cylindrical surface of front housing 16*a* of microphone 11 in a tight, snug fit. Rubber sleeve 64 then fits snugly in a circular opening through inner shell 60. As a result, microphone 11 is held in place.

The noise cancelling microphone 11 shown in FIG. 7 is constructed similarly to the noise cancelling microphone 10 shown in FIGS. 1-5. The only differences are the dimensions of the front and rear housing in that more cavity is formed in front housing 16*a*, and less cavity is constructed in rear housing 18*a*. In addition, annular perforated front element 20*a* is somewhat thicker and protrudes slightly more than its counterpart in noise cancelling microphone 10. The front entering openings are still present in both microphones.

The one common exterior component in both microphones is rear housing cap 22 which, like its counterpart in noise cancelling microphone 10, has openings 24 (and openings 25 on the opposite side) for noise to enter the rear cavity of microphone 11 at an angle transverse to the cylindrical axis of the microphone and the contained microphone cartridge.

Lastly, soft pliable open cell rubber or plastic foam disk 66 resides in a cupped shaped cavity formed by the annularly shaped outwardly protruding wall of sleeve 64. The operator's speech initially enters this foam disk. Leading from noise cancelling microphone 11 are two wires 68 which carry the electrical signals from the microphone.

As mentioned above, noise entering the bottom of the helmet (and around the visor) also enters into the plenum between the inner shell 60 and outer shell 62 and into the noise entering openings 24 (and openings 25) of rear housing cap 22. This noise, coming from behind to impinge upon the rear side of the diaphragm of the enclosed microphone cartridge cancels the like noise on the front entrance side of the diaphragm to result in noise cancellation, giving an output substantially less affected by exterior noise. Speech from the operator does not enter into the plenum between the outer and inner shell (and to the rear of the microphone) so there is no cancellation of the desired speech.

While a preferred embodiment of the invention has been shown and described, together with an alternate embodiment, it will be appreciated that there is no intent to limit the invention by such disclosure. Accordingly, the disclosure is intended to cover all modifications and other alternate embodiments falling within the spirit and the scope of the invention as defined in the appended claims.

We claim:

1. A noise cancelling microphone for use in noisy environments in which a greater proportion of the environmental noise audio sounds received by the microphone emanates from a loud noise source situated at a specific location proximate an operator speaking into the microphone, the noise canceling microphone comprising:

a microphone housing enclosure having a front portion and a rear portion, said front portion having a plurality of openings therethrough to allow speech audio sounds to enter said enclosure, said front portion situated directly in front of the operator's mouth, the environmental noise audio sounds also entering said openings in said front portion;

a microphone cartridge situated interiorly to said microphone housing enclosure at a fixed location proximate said front portion openings, said microphone cartridge having a diaphragm with a front audio sound receiving surface and a rear audio sound receiving surface, said microphone cartridge so oriented that said diaphragm front audio sound receiving surface is in a direct line to the mouth of the operator to receive the speech entering said openings of said housing front portion;

means by which a selected amount of the environmental noise audio sounds emanating from the loud noise source at the specific location may be permitted to enter the rear portion of said microphone housing enclosure, said means including at least one directional opening oriented in the direction of the location of the specifically located loud noise source when the operator is speaking into said openings in said microphone housing front portion; and means by which the same environmental noise audio sounds are permitted to impinge upon the rear audio sound receiving surface of said diaphragm of said microphone cartridge to cancel the same environmental noise audio sounds impacting the front audio sound receiving surface of said microphone cartridge diaphragm in order that the microphone cartridge transmit only the speech audio sounds.

2. The noise cancelling microphone as defined in claim 1 wherein said means by which a selected amount of environmental audio noise sounds from the proximate loud noise source enter the rear portion of said microphone housing enclosure includes a plurality of openings through said rear portion of said microphone housing enclosure, said plurality of openings through said rear portion directionally oriented towards said specific noise source whereby the same environmental noise audio sounds which enter the front portion of said microphone housing also enter the rear portion of said microphone housing, both said environmental noise audio sounds impinging simultaneously upon the front and the rear surfaces of the microphone cartridge to effect a cancellation thereby.

3. The noise cancelling microphone as defined in claim 2 wherein each of said plurality of openings through said rear portion of said microphone housing enclosure have a length and a diameter, and said openings through said front portion of said microphone housing enclosure also have a length and a diameter, and are parallel to each other, said openings through said rear portion of said microphone housing enclosure being orthogonal to said plurality of openings through said front portion of said microphone housing enclosure, said diameter of said openings through said rear portion varied to selectively control the environmental sounds entering said microphone housing enclosure rear portion.

4. The noise cancelling microphone as defined in claim 3 wherein said plurality of openings through said rear portion of said microphone housing enclosure are parallel to each other.

5. The noise cancelling microphone as defined in claim 2 wherein said means permitting the environmental noise audio sounds to impinge upon said microphone cartridge diaphragm rear audio sound receiving surface includes a microphone cartridge socket, said socket receiving and securing said microphone cartridge within itself, said socket operably situated interiorly to said microphone housing to position said microphone cartridge diaphragm rear audio sound receiving surface to receive the environmental noise audio sounds.

6. The noise cancelling microphone as defined in claim 5 including means to noise insulate said microphone cartridge socket from said microphone housing enclosure, said means to insulate defining at least one rubber grommet, said grommet operably interposed said microphone housing enclosure and said cartridge socket.

7. The noise cancelling microphone as defined in claim 6 wherein said cartridge socket includes a top lid, said top lid having at least one opening therethrough, said opening permitting the passage of speech audio sounds and environmental noise audio sounds into said socket to impinge upon said front audio sound receiving surface of said diaphragm of said microphone cartridge.

8. The noise cancelling microphone as defined in claim 7 wherein said plurality of directional openings in said microphone housing enclosure front portion are proximate said opening in said cartridge socket top lid whereby audio sounds entering said microphone housing front portion impinge upon said front surface of said diaphragm of said microphone cartridge.

9. The noise cancelling microphone as defined in claim 8 wherein said cartridge socket includes a base, said base having at least one opening therethrough, said opening defining said means by which the environmental noise audio sounds are permitted to impinge upon the rear audio receiving surface of said diaphragm of said microphone cartridge simultaneously with said environmental noise audio sounds impinging upon said front audio receiving surface of said diaphragm of said microphone cartridge to thereby effect a cancellation of said environmental noise audio sounds.

10. The noise cancelling microphone as defined in claim 9 wherein said opening through said base of said cartridge socket is proximate said opening through said rear portion of said microphone housing enclosure.

11. The noise cancelling microphone as defined in claim 10 wherein said plurality of openings in said front portion of said microphone housing are sound directional openings.

12. The noise cancelling microphone as defined in claim 6 wherein said rubber grommet noise insulating said microphone cartridge socket from said microphone housing enclosure defines a plurality of rubber grommets, said plurality of rubber grommets operably interposed said microphone housing enclosure and said cartridge socket.

13. The noise cancelling microphone as defined in claim 7 wherein said opening through said cartridge socket top lid defines a plurality of openings, said plurality of openings permitting the passage of speech audio sounds and environmental noise audio sounds into said cartridge socket.

14. The noise cancelling microphone as defined in claim 9 wherein said opening through said base of said cartridge socket defines a plurality of openings, said plurality of openings permitting environmental noise audio sounds to pass through said base to impinge upon the rear audio receiving surface of said diaphragm of said microphone cartridge.

* * * * *